US012196485B2

(12) United States Patent
Golubev

(10) Patent No.: US 12,196,485 B2
(45) Date of Patent: Jan. 14, 2025

(54) METHOD AND APPARATUS FOR OBTAINING PRESSURIZED NITROGEN BY CRYOGENIC SEPARATION OF AIR

(71) Applicant: LINDE AKTIENGESELLSCHAFT, Munich (DE)

(72) Inventor: Dimitri Golubev, Geretsried (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 1240 days.

(21) Appl. No.: 16/265,120

(22) Filed: Feb. 1, 2019

(65) Prior Publication Data

US 2019/0242646 A1 Aug. 8, 2019

(30) Foreign Application Priority Data

Feb. 2, 2018 (DE) ..... 102018000842.9

(51) Int. Cl.
*F25J 3/02* (2006.01)
*F25J 3/04* (2006.01)

(52) U.S. Cl.
CPC ..... *F25J 3/0257* (2013.01); *F25J 3/04181* (2013.01); *F25J 3/0423* (2013.01); (Continued)

(58) Field of Classification Search
CPC ..... F25J 3/0257; F25J 3/04; F25J 3/04181; F25J 3/04145; F25J 3/04442
See application file for complete search history.

(56) References Cited

U.S. PATENT DOCUMENTS 4,453,957 A * 6/1984 Pahade ..... F25J 3/0429 62/651
6,196,023 B1 * 3/2001 Corduan ..... F25J 3/04418 62/650

(Continued)

FOREIGN PATENT DOCUMENTS

WO WO-2016131545 A1 * 8/2016 ..... F25J 3/04018

OTHER PUBLICATIONS

WO-2016131545-A1 Translation.*

*Primary Examiner* — Brian M King
(74) *Attorney, Agent, or Firm* — Millen, White, Zelano & Branigan, P.C.; Brion P. Heaney

(57) ABSTRACT

The distillation column system has a high-pressure column, a low-pressure column, a main condenser and a low-pressure-column top condenser. Feed air is cooled in a main heat exchanger and introduced into the high-pressure column. An oxygen-enriched liquid stream is withdrawn from the high-pressure column and introduced into the low-pressure column. A gaseous nitrogen stream is withdrawn from the high-pressure column, warmed in the main heat exchanger and withdrawn as gaseous pressurized nitrogen product. The high-pressure column has a barrier-plate section arranged immediately above the point at which the feed air is introduced. The oxygen-enriched liquid stream is withdrawn from the high-pressure column above the barrier-plate section. A purge stream is withdrawn below the barrier-plate section. The gaseous nitrogen stream, before being warmed in the main heat exchanger, is warmed in a counter-current subcooler in indirect heat exchange with the oxygen-enriched liquid stream from the high-pressure column.

21 Claims, 5 Drawing Sheets

(52) U.S. Cl.
CPC ..... *F25J 3/04321* (2013.01); *F25J 3/04412* (2013.01); *F25J 3/04442* (2013.01); *F25J 3/04854* (2013.01); *F25J 2200/04* (2013.01); *F25J 2200/20* (2013.01); *F25J 2200/54* (2013.01); *F25J 2200/94* (2013.01); *F25J 2230/42* (2013.01); *F25J 2230/50* (2013.01); *F25J 2230/52* (2013.01); *F25J 2235/42* (2013.01); *F25J 2245/42* (2013.01); *F25J 2250/02* (2013.01)

(56) References Cited

U.S. PATENT DOCUMENTS

| | | | | |
|---|---|---|---|---|
| 2001/0032480 | A1* | 10/2001 | Mostello | F25J 3/04284 62/643 |
| 2010/0242537 | A1* | 9/2010 | Lochner | F25J 3/04236 62/644 |
| 2017/0211879 | A1* | 7/2017 | Igra | F25J 3/0489 |
| 2018/0023890 | A1* | 1/2018 | Golubev | F25J 3/0406 62/650 |

* cited by examiner

METHOD AND APPARATUS FOR OBTAINING PRESSURIZED NITROGEN BY CRYOGENIC SEPARATION OF AIR

The invention relates to a method for obtaining compressed nitrogen by cryogenic separation of air in a distillation column system having a high-pressure column, a low-pressure column, a main condenser in the form of condenser-evaporator, and a low-pressure-column top condenser in the form of condenser-evaporator. In the method, compressed and cleaned feed air is cooled in a main heat exchanger and introduced into the high-pressure column at least mostly in gaseous form. An oxygen-enriched liquid stream is withdrawn from the high-pressure column and introduced into the low-pressure column, and a gaseous nitrogen stream is withdrawn from the high-pressure column, warmed in the main heat exchanger and drawn off as gaseous pressurized nitrogen product.

The method relates in particular to systems involving the withdrawal of nitrogen product from the high-pressure column. The nitrogen product can come from both columns, for example by gaseous nitrogen (GAN) being passed both directly out of the low-pressure column and out of the high-pressure column. Alternatively, at least a part of the low-pressure-column nitrogen can be withdrawn in liquid form (LIN—liquid nitrogen), fed into the high-pressure column and drawn off therefrom as a GAN product. Such methods involving low-pressure-column LIN being "pumped back" into the high-pressure column are known from US 2004244417 A1, FIG. 2, DE 19933557 or EP 1022530. In such processes, main condensers and low-pressure-column top condensers are generally used, which are in the form of bath evaporators on their evaporation side. This represents the tried-and-tested evaporator form, in which in particular no operational difficulties on account of volatile components that are heavier than oxygen, for example propane, should be expected. However, in terms of energy, bath condensers are not optimal, because the hydrostatic level in the liquid bath leads to an increased evaporation temperature.

The invention is based on the object of improving the method mentioned at the beginning and a corresponding apparatus in terms of energy consumption and at the same time to allow safe operation of the system.

This object is achieved by a method wherein:

- compressed and cleaned feed air is cooled in a main heat exchanger and introduced into the high-pressure column at least mostly in gaseous form;
- an oxygen-enriched liquid stream is withdrawn from the high-pressure column and introduced into the low-pressure column;
- a gaseous nitrogen stream is withdrawn from the high-pressure column, warmed in the main heat exchanger and drawn off as gaseous pressurized nitrogen product;
- the evaporation space of the low-pressure-column top condenser is in the form of a forced-flow evaporator;
- the high-pressure column has a barrier-plate section, which is arranged immediately above the point at which the feed air is introduced, and has one to five theoretical or practical plates;
- the oxygen-enriched liquid stream introduced into the low-pressure column is withdrawn from the high-pressure column above the barrier-plate section;
- a purge stream is withdrawn below the barrier-plate section and removed from the distillation column system; and
- the gaseous nitrogen stream, before being warmed in the main heat exchanger, is warmed in a counter-current subcooler in indirect heat exchange with the oxygen-enriched liquid stream from the high-pressure column, and thus the fraction of air which is passed into the high-pressure column in liquid form is reduced.

The use of a forced-flow evaporator as low-pressure-column top condenser allows a particularly lower pressure difference between the evaporating and the condensing stream with the same average temperature difference as in a bath evaporator. This noticeably reduces the energy consumption of the plant, for example by 3.2% at a product output pressure in the nitrogen of 10 bar, which corresponds to the high-pressure-column pressure; if a further compression from 10 to 60 bar is also figured in, the energy saving is 2.2% of the total energy consumption.

However, the loss of the liquid bath above the low-pressure column is also accompanied by the loss of the possibility of withdrawing a purge stream and discharging high-boiling components, in particular propane. In the invention, this is compensated in that a purge stream is drawn off from the bottom of the high-pressure column. Above this withdrawal (and the infeed of feed air), a barrier-plate section is provided, which retains the high-boiling components, in particular propane, in the bottom of the high-pressure column. The oxygen-enriched liquid stream for the low-pressure column is withdrawn above the barrier-plate section and contains fewer high-boiling components and in particular virtually no propane any more. Even with two theoretical plates in the barrier-plate section, given a propane content of 0.0075 ppm in the air downstream of the air cleaner (with an exemplary assumption for propane retention in the molecular sieve of the air cleaner of about 85%), 99.8% of the propane is removed with the purge stream. In the process, 84% of the $N_2O$ is also separated out (relative to the $N_2O$ quantity which passes through the air cleaner). The degrees of separation of other components are 69% for $C_2H_6$, 15% for $C_2H_4$ and about 2.5% for methane, which is less critical. "High-boiling components" are understood here to be substances which have a higher evaporation temperature than oxygen.

In principle, the abovementioned measures can be used to ensure safe operation of the plant. These measures are known per se from WO 2016131545 A1, but are applied therein at a relatively high process pressure, which has the result that there is no pre-liquefaction, i.e. no liquefaction of the feed air upstream of the distillation; rather all the air is introduced into the high-pressure column in gas form.

Overall, there are the following differences between the method mentioned at the beginning according to US 2004244417 A1, FIG. 2 and that of WO 201 61 31 545 A1:

| US 2004244417 A1 | WO 2016131545 A1 |
|---|---|
| High air pressure, much greater than high-pressure-column pressure. | Total air is compressed only to high-pressure-column pressure. |
| 10% liquid production | Gaseous high-pressure nitrogen as main product |
| Large throttle stream (total air without turbine air) over 232 | No throttle stream |
| Bath evaporator | Forced-flow evaporator |
| Residual-gas turbine makes only cold (does not drive a cold compressor) | Residual-gas turbine makes only pressure (drives a cold compressor) |

The two methods have such different natures that there would be no question of combining them for an impartial person skilled in the art.

In US 2004244417 A1, on account of the relatively low pressure in the process (or relatively small pressure difference with the streams emerging from the rectification system), the feed air also contains a small liquid content during the feed into the high-pressure column - this would be the case even with very little liquid product being obtained or purely gas operation. Therefore, a relatively large quantity of liquid would end up in the bottom of the high-pressure column, if the abovementioned measures (see also WO 2016131545 A1) were applied to one of these methods. This quantity would be drawn off as a whole with the purge stream and noticeably reduce the product yield or have a negative effect on the energy consumption of the plant.

For this reason, the inventive method further includes the feature wherein, the gaseous nitrogen stream from the high-pressure column, before being warmed in the main heat exchanger, is warmed in a counter-current subcooler in indirect heat exchange with the oxygen-enriched liquid stream from the high-pressure column. At first look, it appears unclear what this measure is supposed to have to do with the discharging of the high-boiling components. At any rate, it results in an increase in the enthalpy of the gaseous nitrogen stream at the inlet into the main heat exchanger. Since the difference in enthalpy of a balancing group remains unchanged around the distillation column system (with unchanged product quantities and constant heat input from the environment), this causes a temperature increase at the cold end of the main heat exchanger. This is experienced by the cooling feed air stream; therefore, it likewise has higher enthalpy and a higher temperature than in the absence of warming of the nitrogen in the counter-current subcooler. This increase in enthalpy prevents or reduces pre-liquefaction of the air and in many cases even has the result that the air stream is slightly superheated at the inlet into the high-pressure column, i.e. its temperature is slightly above the dew point temperature; the temperature difference with respect to the dew point in the case of superheating is for example 1.4 K (in the method in which low-pressure-column LIN is "pumped back" into the high-pressure column and the nitrogen product is withdrawn primarily from the high-pressure column). Thus, at the inlet into the high-pressure column, the feed air no longer contains any liquid and the purge stream consists only of the reflux liquid, which exits the barrier-plate section at the bottom.

With regard to a feed air quantity of 100 000 $Nm^3/h$, this feed-air superheating, brought about by the warming of the pressurized nitrogen in the counter-current subcooler, is substantial and corresponds to a liquid production of about 1000 $Nm^3/h$ of liquid nitrogen. It is thus possible for example for about 1% of the air quantity to be obtained as liquid product, without pre-liquefaction occurring; rather, the overall air quantity can be introduced into the high-pressure column in gas form. However, even at higher quantities of liquid nitrogen production (up to about 2% of the air quantity), there is still a certain amount of superheating in the air stream, since with increasing liquid product, the feed air pressure is raised.

In a specific numerical example for a plant with 100 000 $Nm^3/h$ of feed air and a liquid production of less than 0.1% of the feed air quantity, in the following text, the invention is compared with an operating mode in which the pressurized nitrogen is not passed through the counter-current subcooler. If these measures are dispensed with, 96 600 $Nm^3/h$ of air at 8.50 bar and a vapour content of 0.9966864 flow into the high-pressure column, that is to say 320 $Nm^3/h$ of air enter the high-pressure column in liquid form (pre-liquefaction). If, by contrast, the method is run in accordance with the invention, 96 105 $Nm^3/h$ are fed into the high-pressure column at 8.55 bar with superheating of 1.405 K (with a similar size of the main heat exchanger or with the same average temperature in the main heat exchanger compared with the case with warming of the pressurized nitrogen in the counter-current subcooler). Although this temperature difference with respect to the dew point seems slight at first look, it has a very great effect on the process, because it relates of course to the entire air quantity flowing into the high-pressure column.

With the aid of the warming, according to the invention, of the pressurized nitrogen in the counter-current subcooler, the fraction of air which is passed into the high-pressure column in liquid form is therefore reduced in a method in which more pre-liquefaction would otherwise occur. This "reduction" can go as far as zero or furthermore result in superheating of the air fed into the high-pressure column, i.e. in heating beyond the dew point. The invention does not relate to methods in which pre-liquefaction already does not occur without introduction of the pressurized nitrogen into the counter-current subcooler.

The described measure is relatively simple in terms of apparatus, but very effective. It uses equipment that is required anyway, the counter-current subcooler, and allows stable setting of the purge stream quantity which is withdrawn from the high-pressure-column bottom, with good product yield and relatively low energy consumption. This results overall in a particularly efficient method for obtaining pressurized nitrogen.

The operating pressures in the method according to the invention are:

Low-pressure column (at the top): for example 4.0 to 7.0 bar, preferably 4.5 to 6.5 bar High-pressure column (at the top): for example 7 to 12 bar, preferably 8 to 11 bar Low-pressure-column top condenser on the evaporation side: for example 1.5 to 3.5 bar, preferably 1.9 to 3.2 bar With the aid of the invention, pre-liquefaction can be reduced. In individual cases, decreased pre-liquefaction will still occur. Preferably, the pre-liquefaction is completely eliminated by the invention, however; in other words, the feed air flows into the high-pressure column in a fully gaseous state under the dew point or with slight superheating. "Slight superheating" is understood here to mean a temperature difference of at least 0.1 K, for example (depending on liquid production) 0.1 K to 2.0 K, preferably 0.2 K to 1.8 K.

Preferably, the evaporation space operated as a forced-flow evaporator is operated with an oxygen-rich liquid from the low-pressure column; this can come in particular from the bottom of the low-pressure column. The gas generated in the evaporation space of the low-pressure-column top condenser is preferably warmed as residual gas to an intermediate temperature in the main heat exchanger and subsequently expanded in a work-performing manner in a residual-gas turbine, and then reintroduced into the main heat exchanger and warmed to around ambient temperature. As a result, cold for the method can be obtained economically.

The residual-gas turbine can be decelerated by an electric generator or by a compressor. The latter can compress for example the warmed expanded residual gas or a part thereof.

The efficiency of the method can be increased further when the evaporation space of the main condenser is also in the form of a forced-flow evaporator.

The invention also relates to an apparatus for obtaining pressurized nitrogen by cryogenic separation of air with a distillation column system which has a high-pressure column, a low-pressure column, and also a main condenser and a low-pressure-column top condenser, which are both in the form of condenser-evaporators.

The apparatus further includes:

a main heat exchanger for cooling compressed and cleaned feed air and having means for introducing feed air in gas form cooled in the main heat exchanger into the high-pressure column;

means for withdrawing an oxygen-enriched liquid stream from the high-pressure column and for introducing the oxygen-enriched liquid stream into the low-pressure column; and a product line for withdrawing a gaseous nitrogen stream from the high-pressure column for warming the gaseous nitrogen stream in the main heat exchanger and for drawing off the warmed gaseous nitrogen stream as a gaseous pressurized nitrogen product;

wherein the evaporation space of the low-pressure-column top condenser is in the form of a forced-flow evaporator;

the high-pressure column has a barrier-plate section, which is arranged immediately above the point at which the feed air is introduced, and has one to five theoretical or practical plates; and the means for withdrawing an oxygen-enriched liquid stream from the high-pressure column are connected to the high-pressure column above the barrier-plate section;

wherein the apparatus also has:

a purge line for withdrawing a purge stream from the high-pressure column and for removing the purge stream from the distillation column system, wherein the purge line is connected to the high-pressure column below the barrier-plate section; and a counter-current subcooler for warming the gaseous nitrogen stream before it is warmed in the main heat exchanger in indirect heat exchange with the oxygen-enriched liquid stream from the high-pressure column.

BRIEF DESCRIPTION OF THE DRAWINGS

The invention and further details of the invention are explained in more detail in the following text by way of exemplary embodiments illustrated schematically in the drawings, in which:

In FIG. 1*a*, compressed and cleaned feed air arrives via line 1. The initial stages of an air compressor, a pre-cooler and an air cleaner, are not illustrated here and are embodied in a known manner in the exemplary embodiments. The air is cooled almost to its dew point in the main heat exchanger 2 and flows with a certain amount of superheating into the bottom of the high- pressure column 4 of the distillation column system via line 3. The distillation column system also has a main condenser 5, a low-pressure column 6 and a low-pressure-column top condenser 7. The two condensers are in the form of condenser-evaporators; their evaporation spaces are each operated as forced-flow evaporators.

Figure 1A:
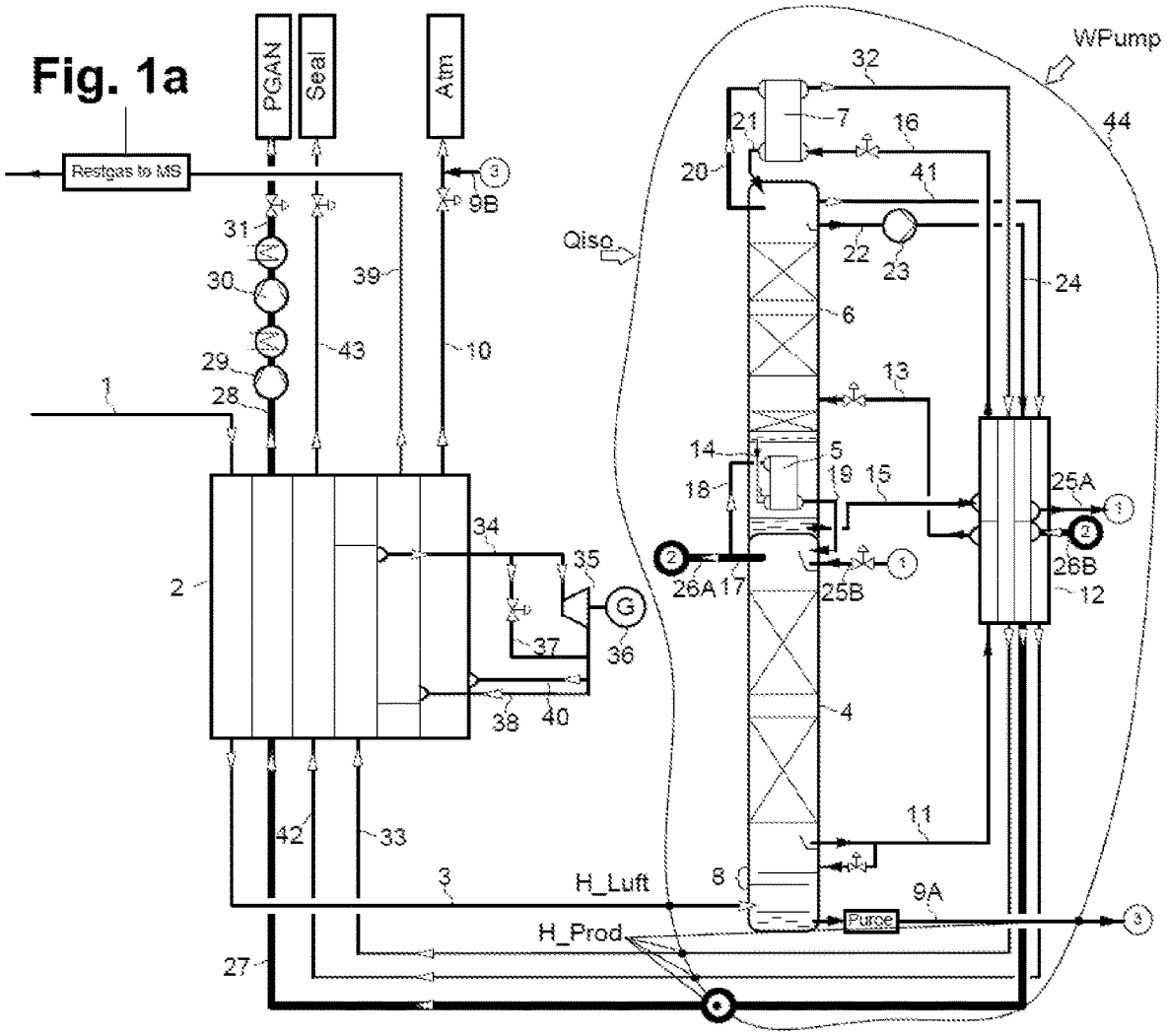
FIG. 1*a* shows a first exemplary embodiment of the invention with a generator turbine.

According to the invention, the high-pressure column 4 has a barrier-plate section 8, which is arranged immediately above the point at which the feed air, via air feed line 3, is introduced. It consists for example of one to five, preferably of two to three conventional rectifier plates. Alternatively, a section with structured packing of for example one to five, preferably two to three theoretical plates can also be used. This section retains high-boiling constituents of the air, in particular propane, which are withdrawn with a purge stream 9A (Purge) from the bottom of the high-pressure column 4 and are removed therewith from the distillation column system. To this end, the purge stream 9B can, as illustrated, be introduced in a warm waste stream via line 10.

Above the barrier-plate section 8, an oxygen-enriched liquid stream 11 is withdrawn from the high-pressure column 4, cooled in a counter-current subcooler 12 and fed to the low-pressure column 6 at an intermediate point via line 13. This stream is virtually free of propane and other high-boiling components. This then also goes for all other oxygen-rich fractions in the low-pressure column, in particular for the bottoms liquid, which can be evaporated without risk both in the main condenser 5 (via line 14) and in the low-pressure-column top condenser 7 (via the lines 15 and 16). Complete evaporation can be carried out without problems in the low-pressure-column top condenser 7. With two theoretical plates in the barrier-plate section, given a propane content of 0.0075 ppm in the air downstream of the air cleaner (with an exemplary assumption for propane retention in the molecular sieve of the air cleaner of about 85%), 99.8% of the propane is removed with the purge stream. In the process, 84% of the $N_2O$ is also separated out (relative to the $N_2O$ quantity which passes through the air cleaner). The degrees of separation of other components are 69% for $C_2H_6$, 15% for $C_2H_4$ and about 2.5% for methane, which is less critical.

In the main condenser 5, a part 18 of the nitrogen tops gas 17 from the high-pressure column 4 is condensed. The liquid nitrogen 19 obtained in the process is returned to the high-pressure column 4 as a recirculation flow. The low-pressure-column top condenser liquefies tops gas 20 from the low-pressure column 6. Liquid nitrogen 21 generated in the process is returned to the low-pressure column 6. A part thereof is immediately drawn off from the low-pressure column 6 again as a liquid nitrogen stream 22. (Alternatively, this stream could also be withdrawn directly from the liquefaction space of the low-pressure-column top condenser 7). A pump 23 brings the liquid nitrogen stream 22 to approximately high-pressure-column pressure. The pressure liquid 24 is supplied to the top of the high-pressure column 4 via the counter-current subcooler 12 and line 25A/25B.

A gaseous nitrogen stream from the top of the high-pressure column 4 is withdrawn via line 17/26A/26B and initially warmed according to the invention in the counter-current subcooler 12. Subsequently, the nitrogen 27 is warmed in the main heat exchanger to around ambient temperature and can be drawn off at 28 as gaseous pressurized nitrogen product under high-pressure-column pressure. In this example, however, it is compressed even further by one or for example two nitrogen compressors 29, 30 in each case with intermediate cooling or postcooling, such that the final pressurized nitrogen product 31 (PGAN) exhibits a pressure of for example 120 or 150 bar here.

As a result of the evaporation of the low-pressure-column bottoms liquid 16 in the low-pressure-column top condenser 7, a residual gas 32 is generated, which is initially warmed in the counter-current subcooler 12. Subsequently, it flows via line 33 to the main heat exchanger 2, in which it is warmed to an intermediate temperature. Subsequently, it is expanded in a work-performing manner in a residual-gas turbine 35 with a bypass 37. The turbine 35 is decelerated by a generator 36. The expanded residual gas is reintroduced in two parts into the main heat exchanger and warmed to around ambient temperature. A first part 38 is fed as regeneration gas to the air cleaner via line 39. The rest 40 is discharged into the atmosphere (ATM) via line 10.

A part 41 of the tops gas of the low-pressure column 6 is discharged via the lines 42 and 43 and through the counter-current subcooler 12 and the main heat exchanger 2 as sealing gas (Seal).

The line 44 shows the balancing group around the distillation column system. It intersects the purge gas line 9A, the residual gas line 33 and the sealing gas line 41 and especially the feed air line 3 and the pressurized nitrogen line 27 (illustrated in bold here). H_Luft means the enthalpy of the air stream, H_Prod the enthalpy of the product streams, WPump the heat introduced by the pump 23.

Figure 1B:
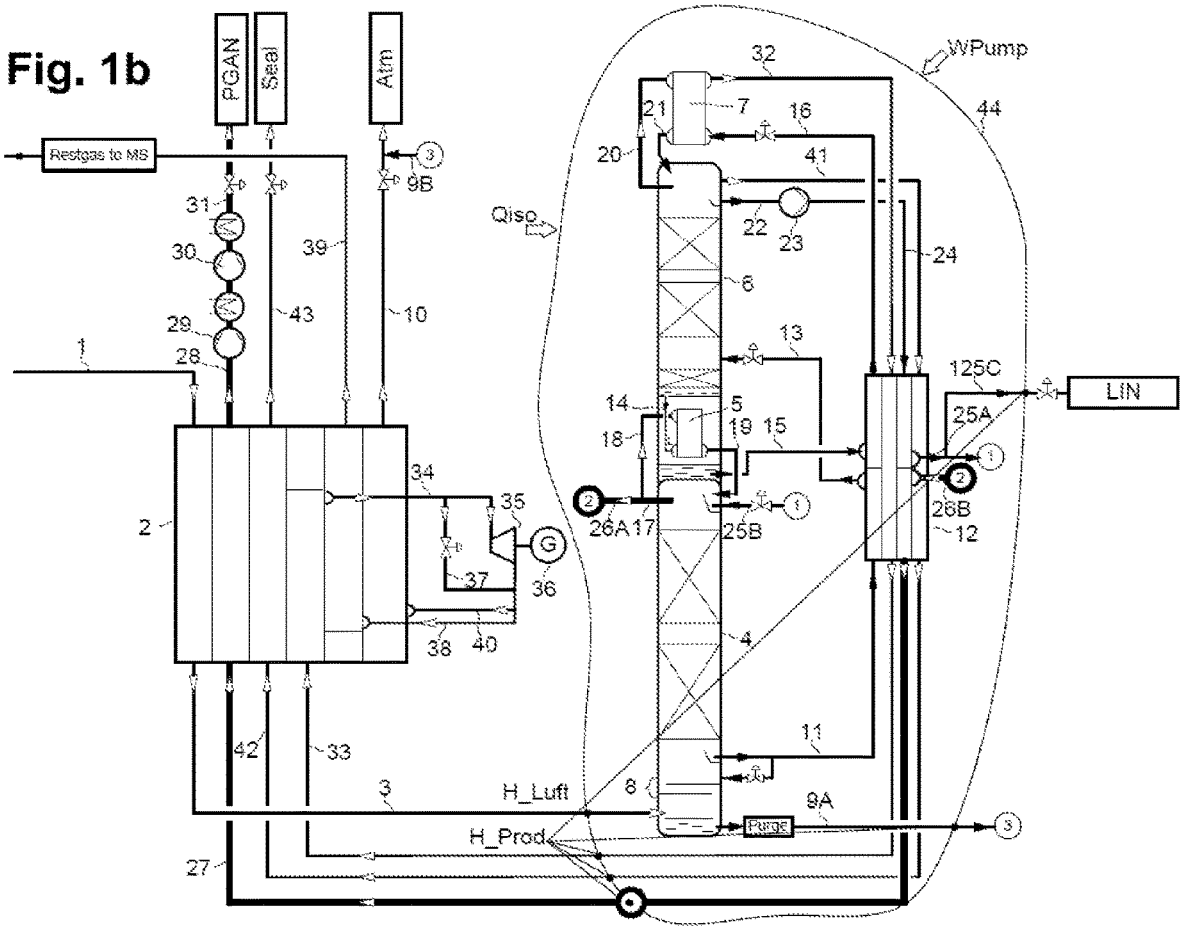
FIG. 1*b* shows a variant of FIG. 1*a* with a liquid nitrogen product being obtained.

FIG. 1*b* differs from FIG. 1*a* only in that a part 125C of the liquid nitrogen 22 warmed in the counter-current subcooler 12 is drawn off as liquid product LIN. Alternatively, the entire stream 25A can be guided via line 125C; the entire gaseous nitrogen product, which comes from the low-pressure column 6, is then drawn off from the low-pressure column 6 via line 41.

Figure 2:
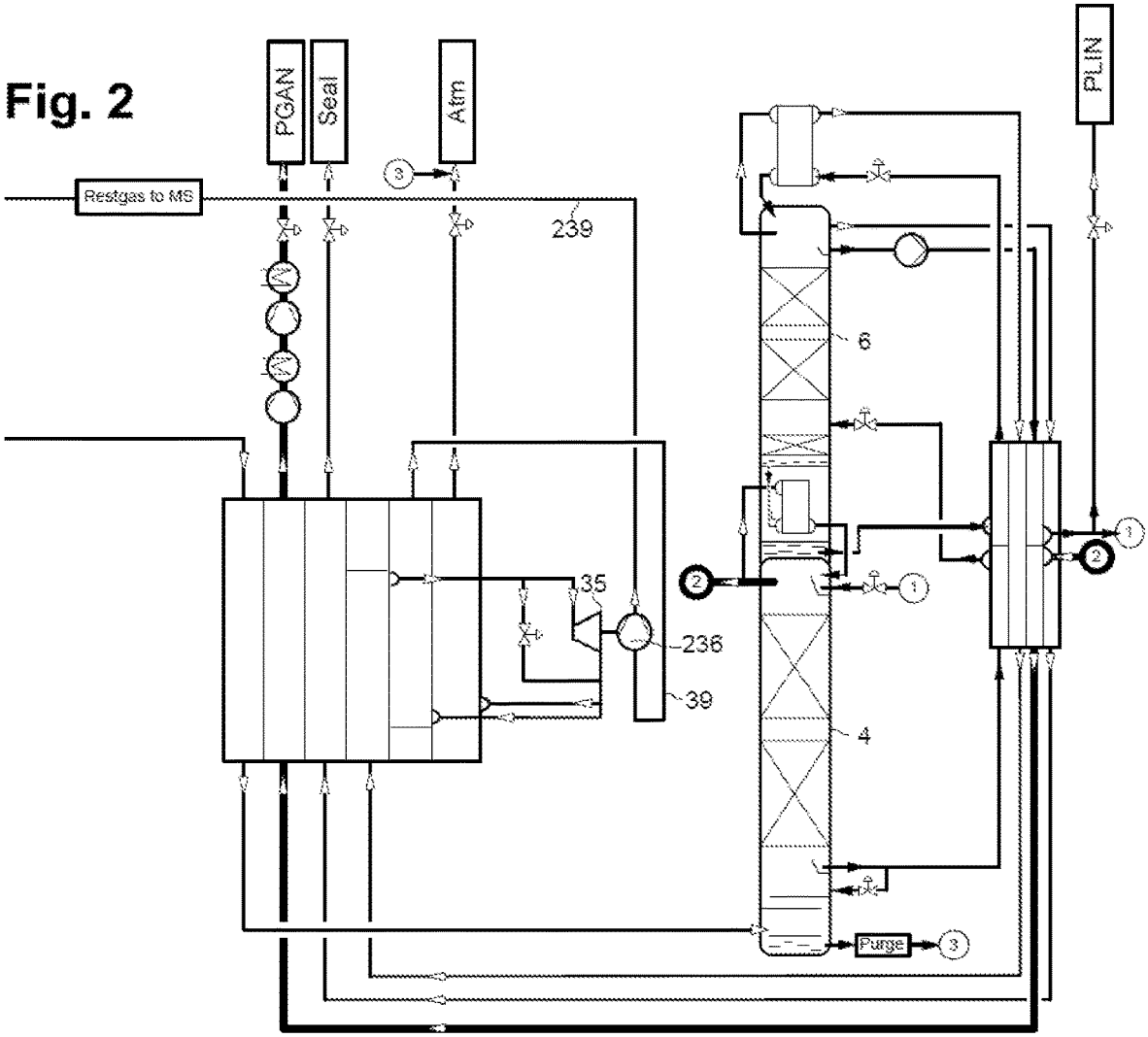
FIG. 2 shows a second exemplary embodiment of the invention with a booster turbine.

FIG. 2 differs from FIG. 1*a* only in that the turbine 35 is decelerated by a compressor 236. The latter brings the part 39 of the warmed expanded residual gas to the pressure that is required in order to employ it as regeneration gas in the air cleaner. As a result, the pressure in the distillation column system and at the outlet of the air compressor (not illustrated) can be reduced and the energy can be saved directly at the air compressor. For example, the pressure at the MAC is lowered by about 500 mbar or even more in this case.

Figure 3:
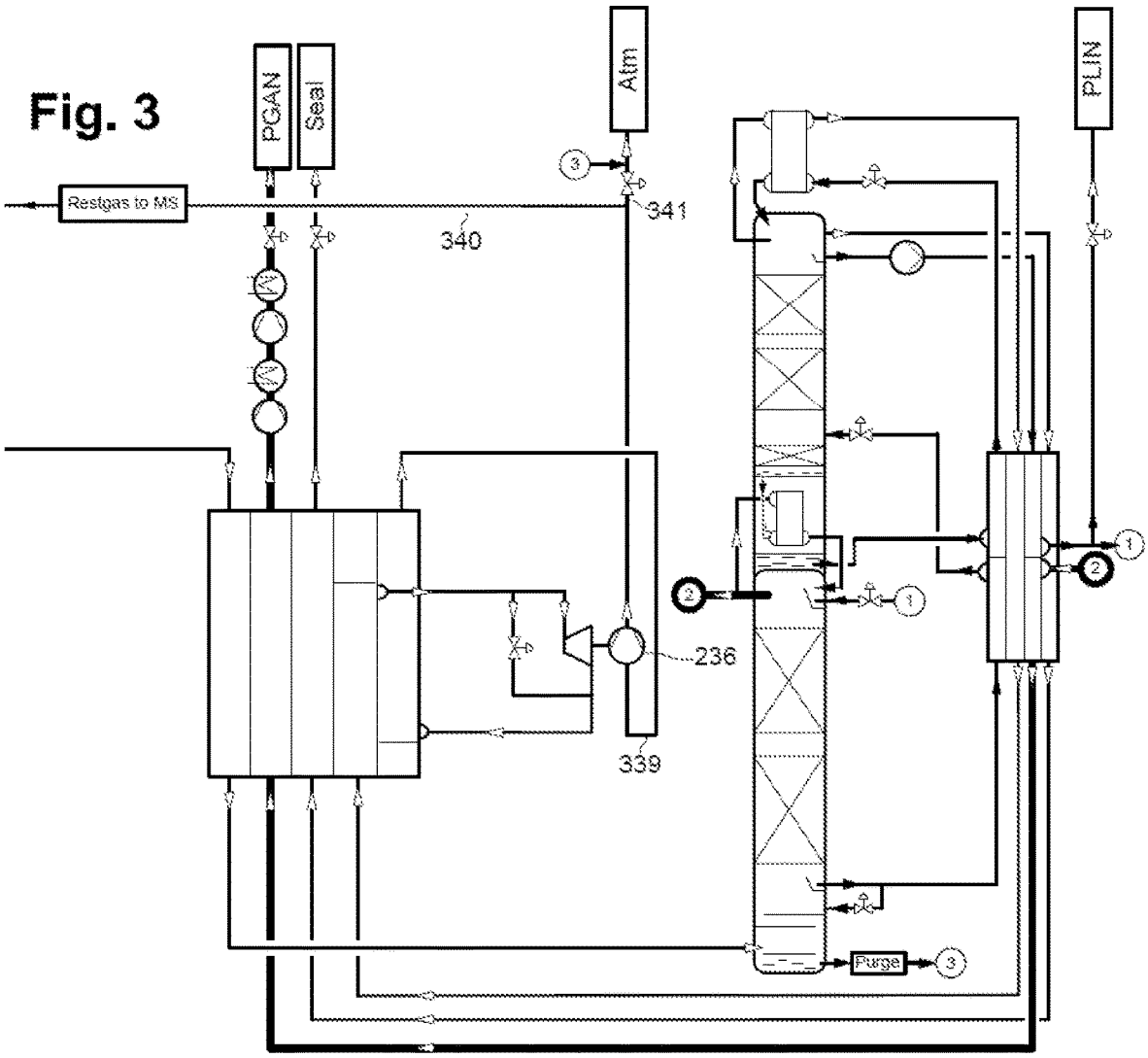
FIG. 3 shows a variant of FIG. 2.

In FIG. 3, in contrast to FIG. 2, the entire expanded and warmed residual gas 339 is compressed in the turbine-driven compressor 236. A first part 340 of the compressed residual gas is used, as in FIG. 2, as regeneration gas; the rest 341 is expanded in a throttle valve and let out into the atmosphere (Atm).

Figure 4:
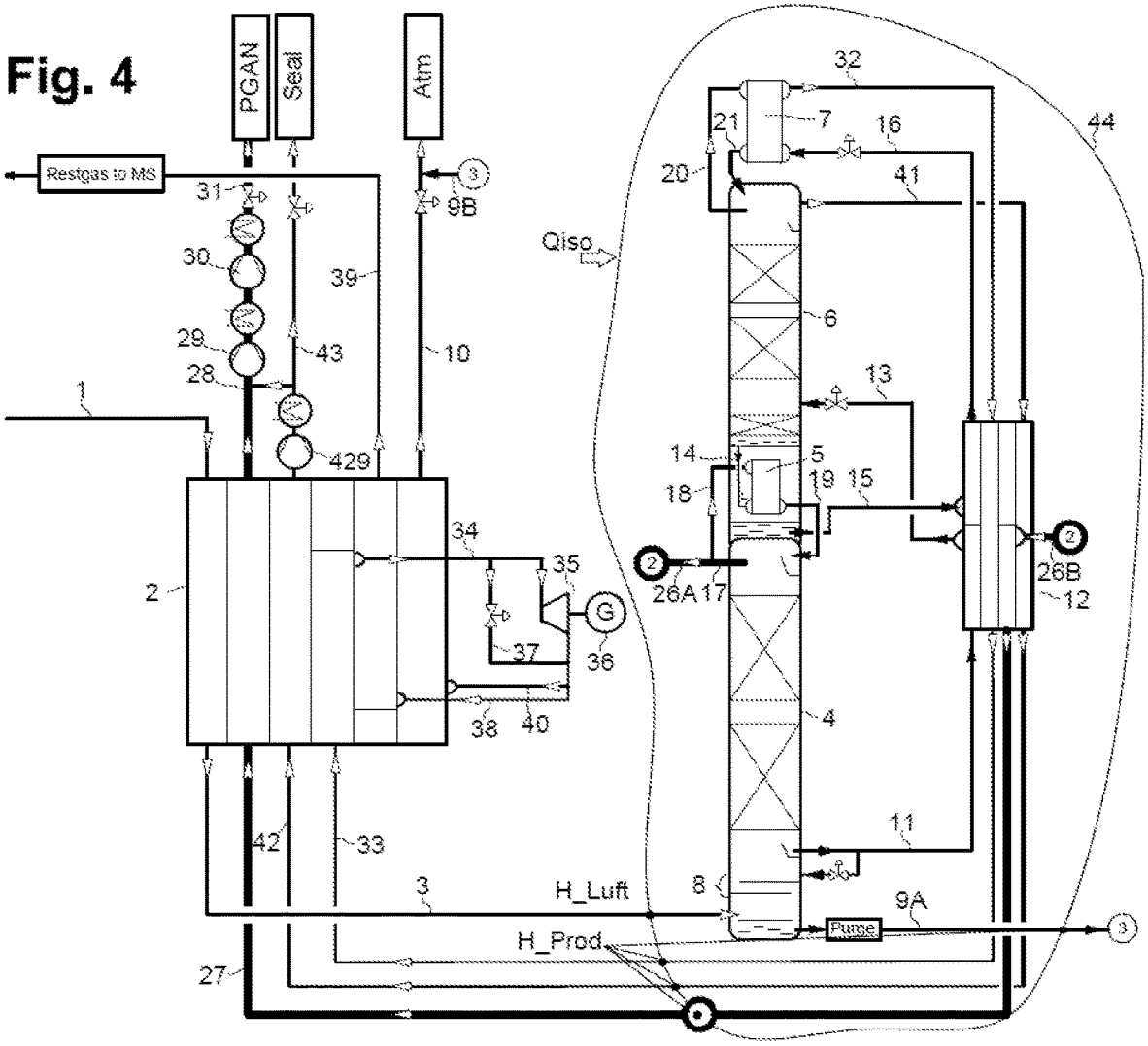
FIG. 4 shows a third exemplary embodiment of the invention with withdrawal of GAN product from both columns.

In the method in FIG. 4, in contrast to the preceding exemplary embodiments, no liquid nitrogen is pumped out of the low-pressure column 6 into the high-pressure column. Rather, the entire nitrogen product of the low-pressure column 6 is withdrawn directly in gas form via line 41/42 and brought to high-pressure-column pressure in the warm state in a further nitrogen compressor 429. It can then be admixed to the nitrogen product 28 from the high-pressure column or be drawn off separately via line 43.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The entire disclosures of all applications, patents and publications, cited herein and of corresponding German application No. 102018000842.9, filed Feb. 2, 2018, are incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A method for obtaining pressurized nitrogen by cryogenic separation of air in a distillation column system which has a high-pressure column, a low-pressure column, a main condenser, and a low-pressure-column top condenser, wherein the main condenser and the low-pressure-column top condenser are both condenser-evaporators which, in each case, has a liquefaction space and an evaporation space, said method comprising:

cooling a compressed and cleaned feed air in a main heat exchanger to form a cooled, compressed, and cleaned and feed air, and introducing the cooled, compressed, and cleaned feed air into the high-pressure column at least mostly in gaseous form, withdrawing an oxygen-enriched liquid stream from the high-pressure column and introducing the oxygen-enriched liquid stream into the low-pressure column, and withdrawing a gaseous nitrogen stream from the high-pressure column, warming the gaseous nitrogen stream in the main heat exchanger to form a warmed gaseous nitrogen stream, and withdrawing the warmed gaseous nitrogen stream as gaseous pressurized nitrogen product, wherein the evaporation space of the low-pressure-column top condenser is a forced-flow evaporator, wherein the high-pressure column has a barrier-plate section, arranged immediately above the point at which the feed air is introduced into the high-pressure column, and said barrier-plate section has one to five theoretical or practical plates, wherein the oxygen-enriched liquid stream which is introduced into the low-pressure column is withdrawn from the high-pressure column above the barrier-plate section, wherein a purge stream is withdrawn below the barrier-plate section and removed from the distillation column system, and wherein the gaseous nitrogen stream, before being warmed in the main heat exchanger, is warmed in a counter-current subcooler in indirect heat exchange with the oxygen-enriched liquid stream from the high-pressure column, which reduces the fraction of air introduced into the high-pressure column in liquid form.

2. The method according to claim 1, wherein the cooled, compressed, and cleaned feed air is introduced into the high-pressure column in gaseous form and is superheated.

3. The method according to claim 1, further comprising withdrawing an oxygen-rich liquid from the low-pressure column and feeding the oxygen-rich liquid to the evaporation space of the low-pressure-column top condenser, warming gas generated in the evaporation space of the low-pressure-column top condenser to an intermediate temperature in the main heat exchanger and removing the gas generated in the evaporation space of the low-pressure-column top condenser from the main heat exchanger as residual gas, and subsequently expanding the residual gas in a work-performing manner in a residual-gas turbine, and introducing the expanded residual gas into the main heat exchanger and warming the expanded residual gas to around ambient temperature.

4. The method according to claim 3, wherein the residual-gas turbine is decelerated by a generator.

5. The method according to claim 3, wherein the residual-gas turbine is decelerated by a compressor which compresses expanded residual gas warmed to around ambient temperature.

6. The method according to claim 1, wherein the evaporation space of the main condenser is a forced-flow evaporator.

7. The method according to claim 1, further comprising withdrawing a liquid-nitrogen stream from the low-pressure column or from the liquefaction space of the low-pressure-column top condenser and introducing at least a part of the liquid-nitrogen stream into the high-pressure column by means of a pump.

8. The method according to claim 1, further comprising withdrawing a gaseous nitrogen stream from the low-pressure column and obtained as a gaseous pressurized nitrogen product.

9. The method according to claim 1, further comprising withdrawing a liquid-nitrogen stream from the low-pressure column, warming the liquid-nitrogen stream in the counter-current subcooler, and withdrawing at least a part of the warmed liquid-nitrogen stream as a liquid nitrogen product.

10. An apparatus for obtaining pressurized nitrogen by cryogenic separation of air, said apparatus comprising:

a distillation column system having a high-pressure column, a low-pressure column, a main condenser and a low-pressure-column top condenser, wherein the main condenser and the low-pressure-column top condenser are both condenser-evaporators, which, in each case, has a liquefaction space and an evaporation space, a main heat exchanger for cooling compressed and cleaned feed air and a line for introducing feed air in gas form cooled in the main heat exchanger into the high-pressure column, a line for withdrawing an oxygen-enriched liquid stream from the high-pressure column and for introducing the oxygen-enriched liquid stream into the low-pressure column, and a product line for withdrawing a gaseous nitrogen stream from the high-pressure column and introducing the gaseous nitrogen stream into the main heat exchanger, wherein the gaseous nitrogen stream is warmed, and a line for withdrawing warmed gaseous nitrogen stream from the main heat exchanger as a gaseous pressurized nitrogen product, wherein the evaporation space of the low-pressure-column top condenser is a forced-flow evaporator, wherein the high-pressure column has a barrier-plate section, arranged immediately above the point at which the feed air is introduced into the high-pressure column, and said barrier-plate section has one to five theoretical or practical plates, and wherein the means for withdrawing an oxygen-enriched liquid stream from the high-pressure column are connected to the high-pressure column above the barrier-plate section, wherein the apparatus further comprises:

a purge line for withdrawing a purge stream from the high-pressure column and for removing the purge stream from the distillation column system, wherein the purge line is connected to the high-pressure column below the barrier-plate section, and a counter-current subcooler for warming the gaseous nitrogen stream, before the gaseous nitrogen stream is warmed in the main heat exchanger, in indirect heat exchange with the oxygen-enriched liquid stream from the high-pressure column.

11. The method according to claim 1, wherein the cooled, compressed, and cleaned feed air is introduced into the high-pressure column in gaseous form and is superheated by at least 0.1 K.

12. The method according to claim 1, wherein the cooled, compressed, and cleaned feed air is introduced into the high-pressure column in gaseous form and is superheated by at least 0.2 K.

13. The method according to claim 1, wherein the cooled, compressed, and cleaned feed air is introduced into the high-pressure column in gaseous form and is superheated by 0.1 K to 2.0 K.

14. The method according to claim 1, wherein the cooled, compressed, and cleaned feed air is introduced into the high-pressure column in gaseous form and is superheated by 0.2 K to 1.8 K.

15. The method according to claim 1, wherein the operating pressure at the top of the low-pressure column is 4.0 to 7.0 bar.

16. The method according to claim 1, wherein the operating pressure at the top of the high-pressure column is 7 to 12 bar.

17. The method according to claim 1, wherein the operating pressure of the low-pressure-column top condenser on the evaporation side is 1.5 to 3.5 bar.

18. The method according to claim 3, wherein, before feeding the oxygen-rich liquid to the evaporation space of the low-pressure-column top condenser, the oxygen-rich liquid is cooled in the counter-current subcooler.

19. The method according to claim 1, wherein the operating pressure at the top of the high-pressure column is 8 to 11 bar.

20. The method according to claim 1, wherein said barrier-plate section consists of two to three theoretical or practical plates.

21. The method according to claim 1, wherein the operating pressure at the top of the low-pressure column is 4.5 to 6.5 bar and the operating pressure at the top of the high-pressure column is 8 to 11 bar.

* * * * *